US011419400B2

(12) United States Patent
Ho

(10) Patent No.: US 11,419,400 B2
(45) Date of Patent: Aug. 23, 2022

(54) CARRYING BAG WITH DETACHABLE STRAP

(71) Applicant: Oxti Corporation, Taipei (TW)

(72) Inventor: Chih Feng Ho, Taipei (TW)

(73) Assignee: OXTI CORPORATION, Taipei (TW)

( * ) Notice: Subject to any disclaimer, the term of this patent is extended or adjusted under 35 U.S.C. 154(b) by 343 days.

(21) Appl. No.: 16/675,355

(22) Filed: Nov. 6, 2019

(65) Prior Publication Data

US 2021/0127810 A1 May 6, 2021

(51) Int. Cl.
*A45C 13/30* (2006.01)
*A45F 3/02* (2006.01)
*A45C 13/10* (2006.01)

(52) U.S. Cl.
CPC ..... *A45C 13/30* (2013.01); *A45C 13/1069* (2013.01); *A45F 3/02* (2013.01)

(58) Field of Classification Search
CPC ..... A45C 13/30; A45C 13/1069; A45F 3/02
USPC ..... 150/110
See application file for complete search history.

(56) References Cited

U.S. PATENT DOCUMENTS 6,968,880 B2 * 11/2005 Battaglia ..... A45C 3/08 150/103
2006/0102260 A1 * 5/2006 Yen ..... A45C 13/22 150/102
2016/0120280 A1 * 5/2016 Dingler ..... A45F 3/02 224/608

* cited by examiner

*Primary Examiner* — John K Fristoe, Jr.
*Assistant Examiner* — Jessica Kavini Tamil
(74) *Attorney, Agent, or Firm* — Browdy and Neimark, PLLC

(57) ABSTRACT

A carrying bag includes a housing, two attachments attached to two side portions of the housing, a strap device having two engaging members at end portions for engaging with the attachments of the housing, and two retaining devices slidably attached to the strap device, the retaining devices each include a spring biasing member for contacting and engaging with the engaging member of the strap device, and a retainer extended from the spring biasing member for contacting and engaging with the engaging member of the strap device and the attachment of the housing and for anchoring and retaining the engaging member of the strap device and the attachment of the housing together.

5 Claims, 9 Drawing Sheets

CARRYING BAG WITH DETACHABLE STRAP

BACKGROUND OF THE INVENTION

1. Field of the Invention

The present invention relates to a package or suitcase or carrying bag for various objects, such as displayer or mobile devices, and more particularly to a package or carrying bag for accommodating or receiving various objects, including an improved detachable carrying strap for easily and quickly and readily attaching to or being detached from the carrying bag and for firmly and solidly and stably attaching to or being detached from the carrying bag.

2. Description of the Prior Art

Typical mobile devices, such as tablets, laptops, notebooks, etc., may normally be accommodated or received or contained within a fold or suitcase or package which comprises a base and a cover foldable relative to each other, and a carrying strap or strap device detachably attached or coupled to the suitcase or package and for carrying the suitcase or package.

Normally, the carrying strap or strap device includes two end portions each having a hook attached or coupled thereto for detachably hooking or coupling to the two end portions of the suitcase or package.

However, the hooks at the two end portions of the carrying strap or strap device may be easily damaged and disengaged from the suitcase or package or the like.

The present invention has arisen to mitigate and/or obviate the afore-described disadvantages of the conventional carrying bag for mobile devices or the like.

SUMMARY OF THE INVENTION

The primary objective of the present invention is to provide a package or suitcase or carrying bag for accommodating or receiving various objects, including an improved detachable carrying strap for easily and quickly and readily attaching to or being detached from the carrying bag and for firmly and solidly and stably attaching to or being detached from the carrying bag.

In accordance with one aspect of the invention, there is provided a carrying bag comprising a housing including two side portions, and two attachments attached to the side portions of the housing respectively, a strap device including two end portions, and two engaging members attached to the end portions of the strap device respectively for engaging with the attachments of the housing respectively, and two retaining devices slidably attached to the strap device, the retaining devices each including a spring biasing member for contacting and engaging with the engaging member of the strap device, and a retainer extended from the spring biasing member for contacting and engaging with the engaging member of the strap device and the attachment of the housing and for anchoring and retaining the engaging member of the strap device and the attachment of the housing together and for preventing the retaining devices from being disengaged or separated from the strap device.

The retaining devices each include a casing having a passage formed in casing for slidably receiving and engaging with the strap device and for allowing the casing of the retaining device to be slidably attached to the strap device. The engaging members of the strap device are preferably selected from a magnetic member. The attachments of the housing are selected from a magnetic member.

The attachments of the housing each include one or more depressions formed in the attachment, and the engaging members of the strap device each include one or more projections for engaging with the depressions of the attachment of the housing and for anchoring the engaging members of the strap device to the attachments of the housing respectively.

The engaging members of the strap device each include one or more recesses formed in the engaging member, and the attachments of the housing each include one or more protrusions for engaging with the recesses of the engaging member and for anchoring the engaging members of the strap device to the attachments of the housing respectively.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
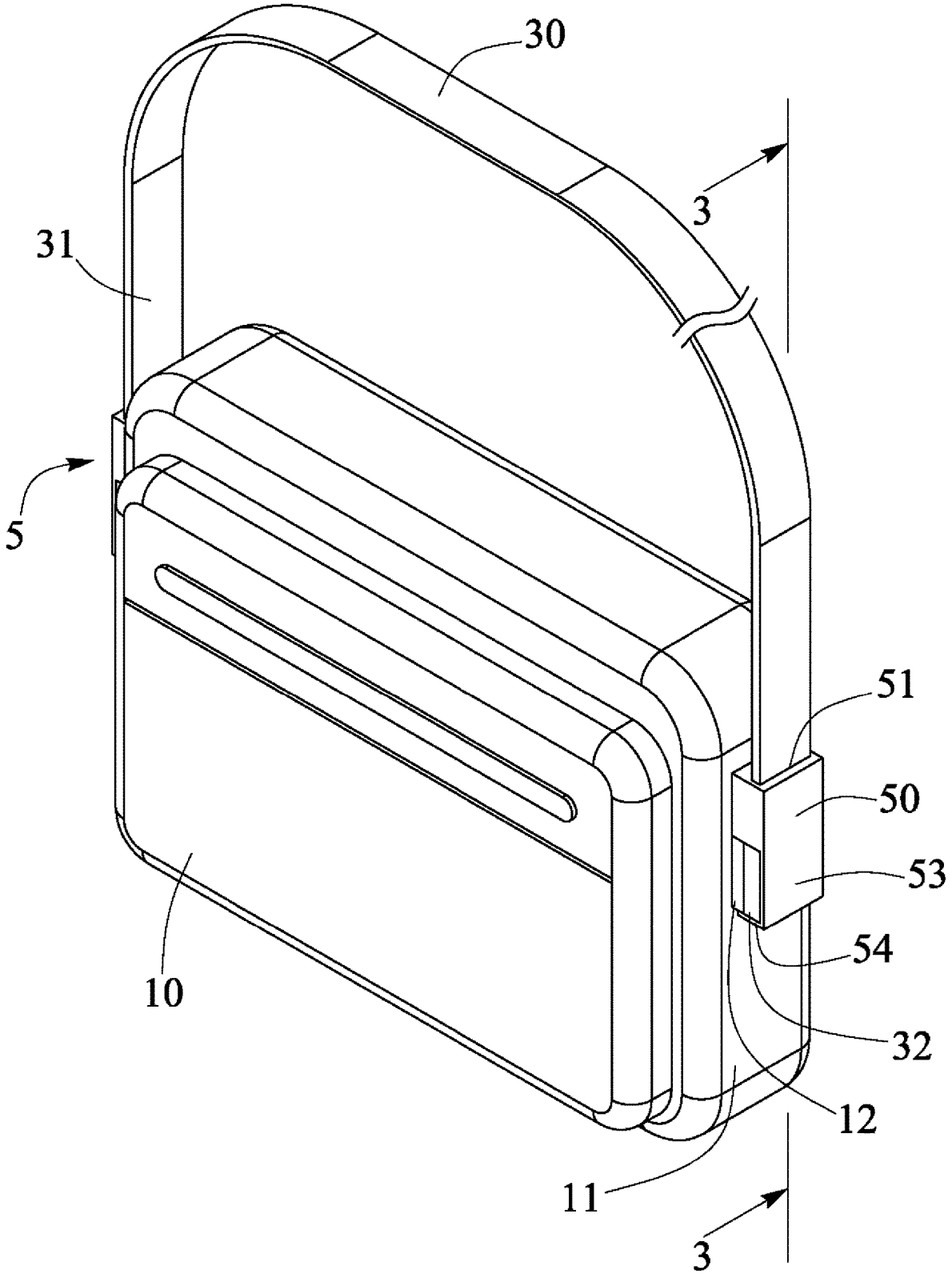
FIG. 1 is a perspective view of a carrying bag in accordance with the present invention.
Figure 2:
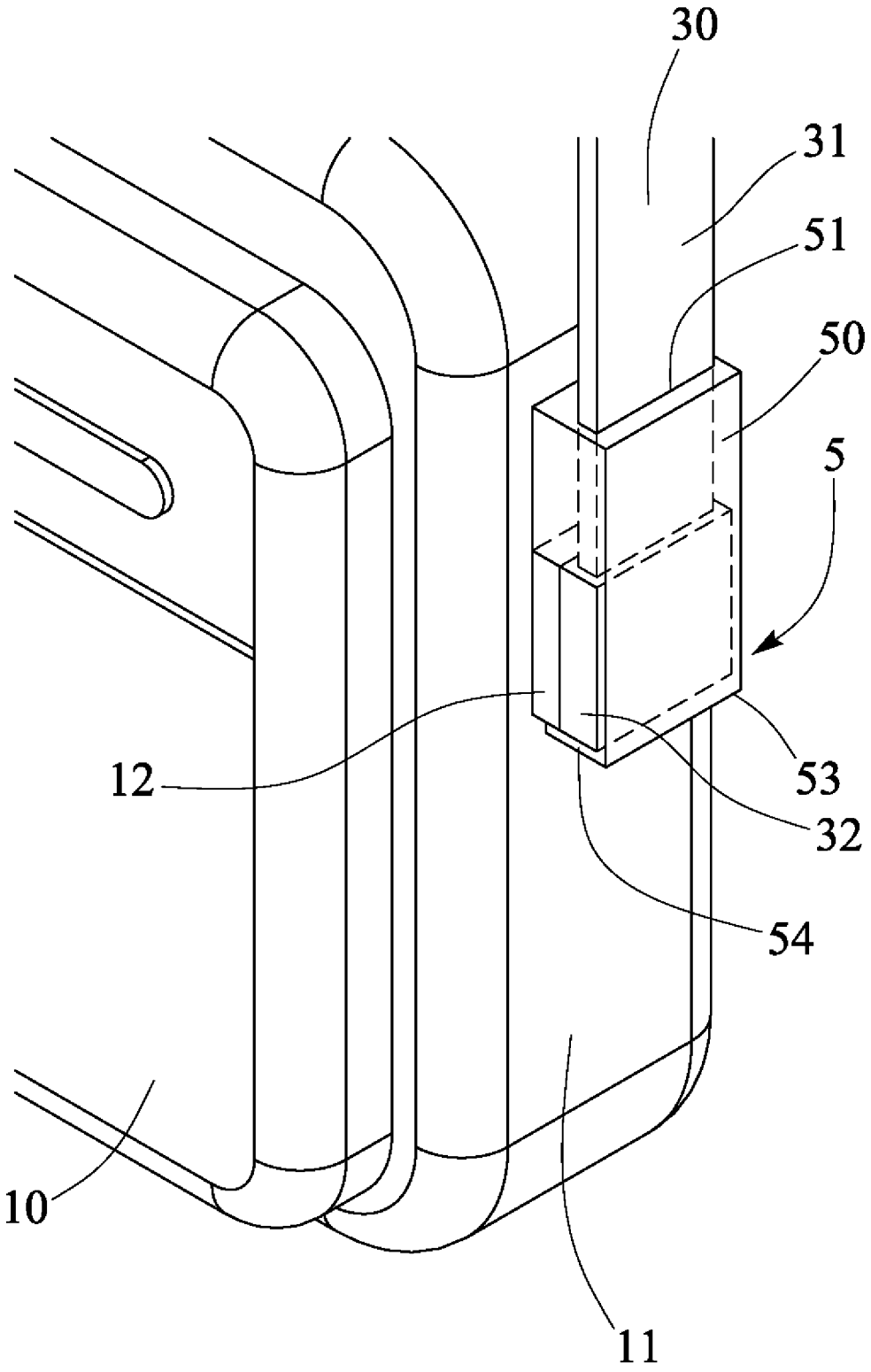
FIG. 2 is an enlarged partial perspective view illustrating the operation of the carrying bag.
Figure 3:
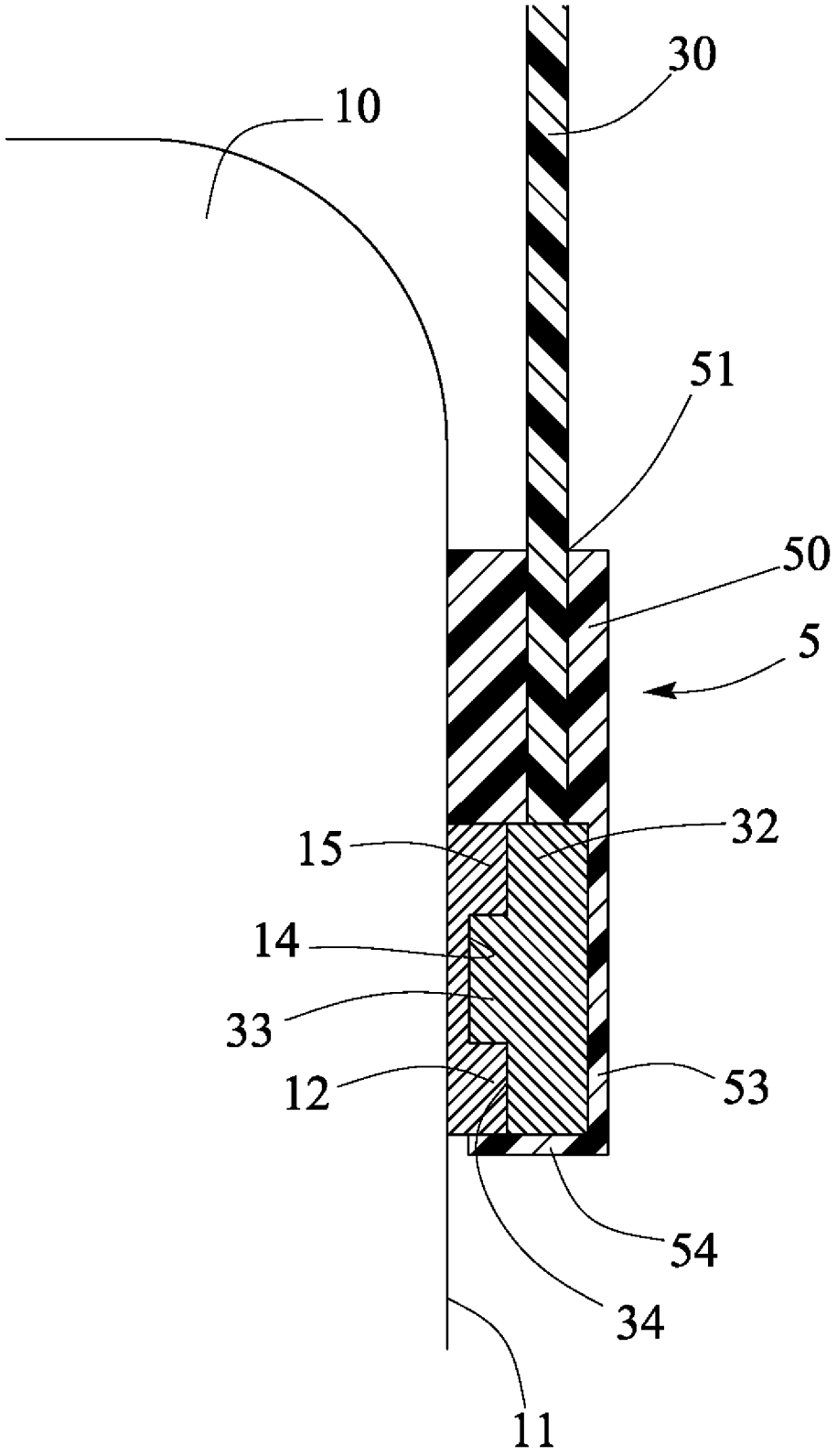
FIG. 3 is a partial cross sectional view of the carrying bag, taken along lines 3-3 of FIG. 1.
Figure 6:
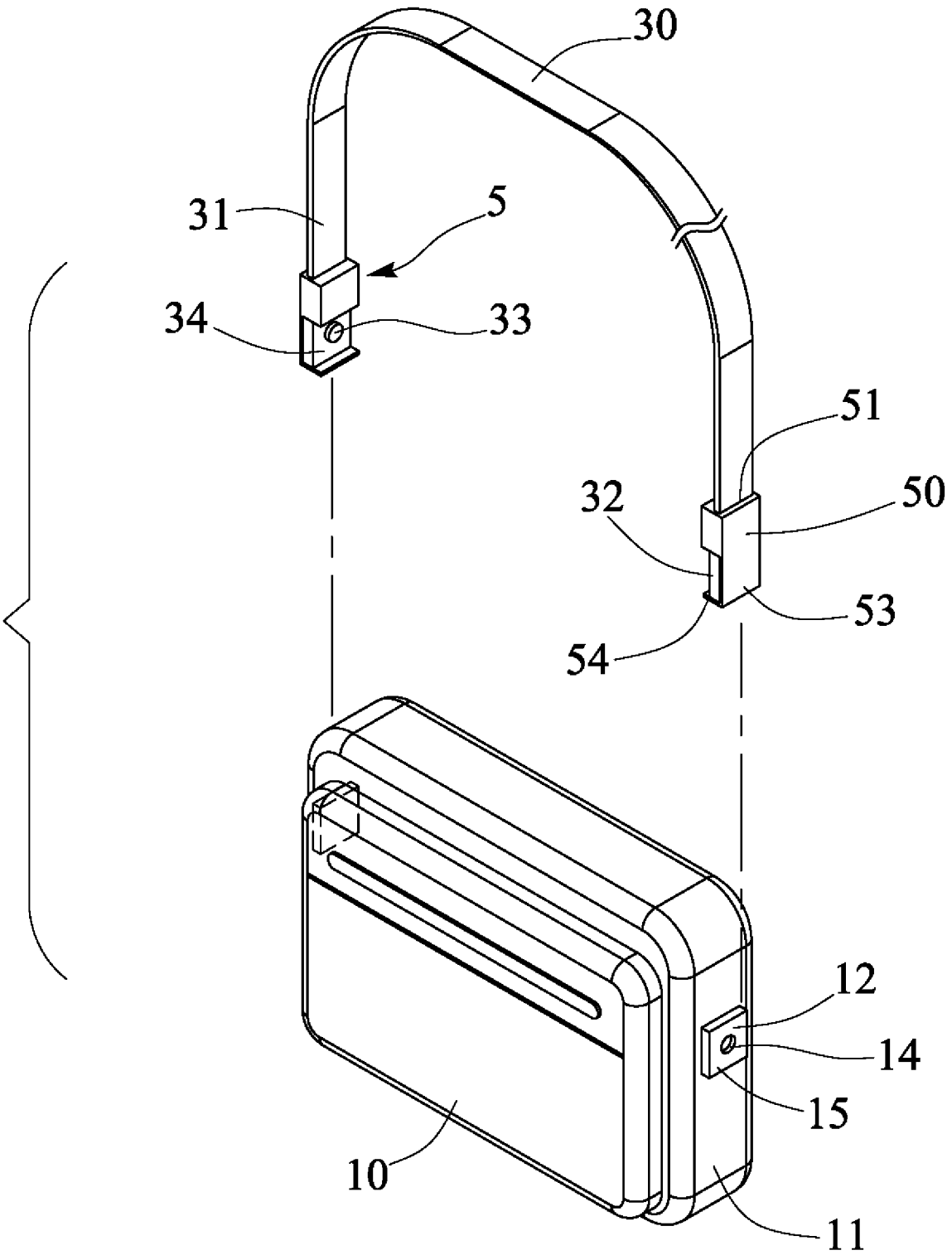
FIG. 6 is a partial exploded view of the carrying bag.

Referring to the drawings, and initially to FIGS. 1 and 2, a carrying bag or suitcase or luggage for accommodating or receiving various objects, such as displayers or mobile devices, in accordance with the present invention comprises a carrying bag body or housing 10 including two side portions 11 each having a coupling member or attachment 12 attached or coupled thereto, for example, the attachments 12 each include one or more cavities or depressions 14 formed therein for forming or defining one or more bulges or protrusions 15 (FIGS. 3, 6). The attachment 12 of the housing 10 may be selected from a catch, a latch, a fastener, a lock, a Velcro device, such as a hook and loop device, a magic sticker, a metal or magnetic member, or the like.

Figure 9:
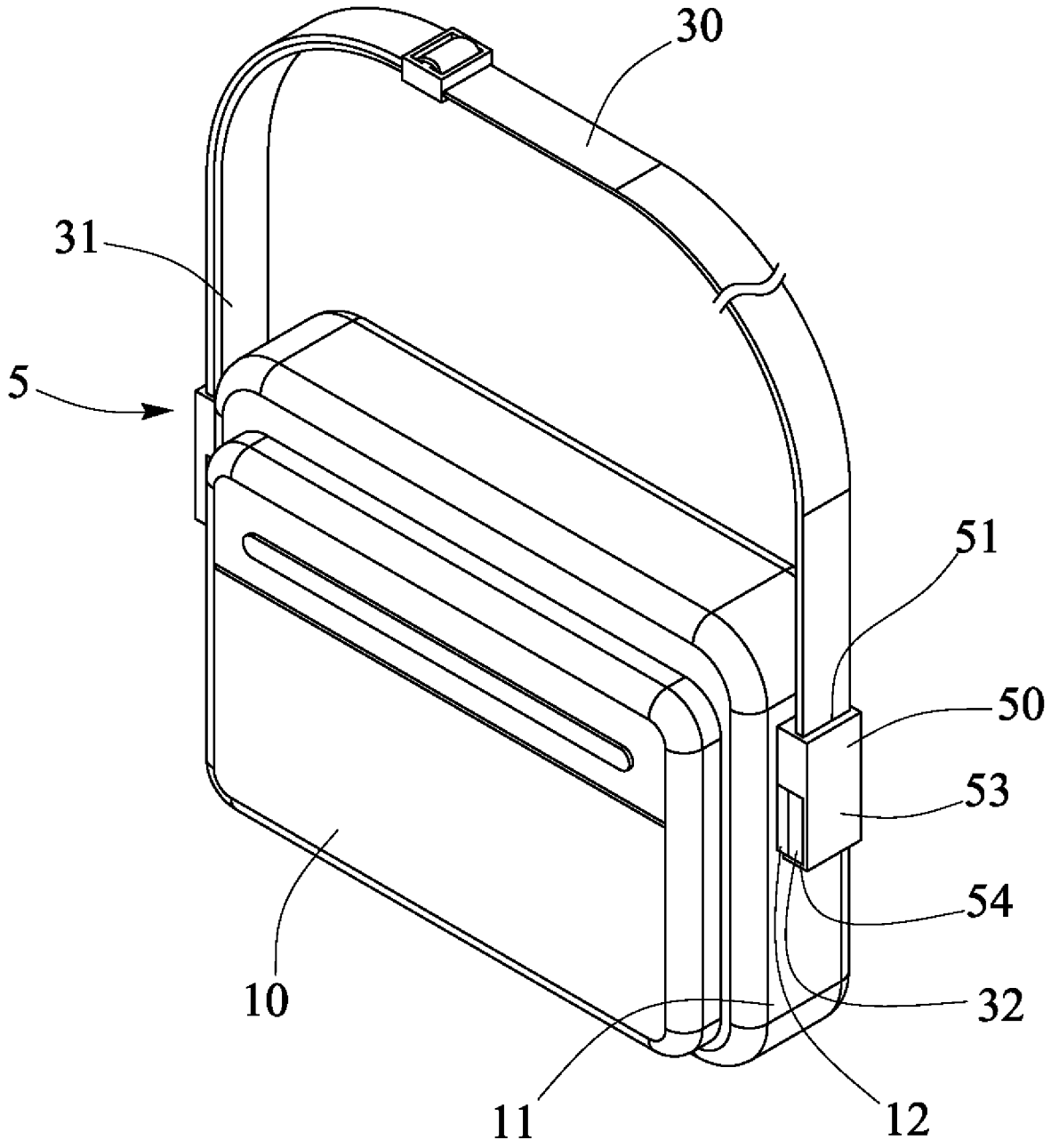

The carrying bag in accordance with the present invention further comprises a carrying strap or strap device 30 detachably attached or coupled to the suitcase housing 10 for carrying the housing 10 of the carrying bag. As also best shown in FIGS. 3 and 6, the strap device 30 includes two end portions 31 each having a hook or engaging member 32 attached or coupled thereto for engaging with the attachments 12 of the housing 10 and for detachably securing or coupling to the two side portions 11 of the housing 10 with the attachments 12 of the housing 10. The engaging members 32 of the strap device 30 may also be selected from a catch, a latch, a fastener, a lock, a Velcro device, such as a hook and loop device, a magic sticker, a metal or magnetic member, or the like. The strap device 30 may include an adjustable structure or configuration (FIG. 9) or the like.

Particularly, the attachments 12 of the housing 10 and the engaging members 32 of the strap device 30 may be selected from a magnetic member for attracting to each other and for detachably securing or coupling the strap device 30 to the housing 10. The engaging members 32 of the strap device 30 each may also include one or more bulges or projections 33 extended therefrom for engaging with the depressions 14 of the attachments 12 of the housing 10 and for anchoring or retaining or positioning the engaging members 32 of the strap device 30 to the attachments 12 of the housing 10 respectively, and also for forming or defining one or more cavities or recesses 34 therein and for receiving or engaging with the protrusions 15 of the housing 10 respectively.

The carrying bag in accordance with the present invention further comprises one or more (such as two) anchoring or retaining devices 5 attached or mounted or secured to the strap device 30, particularly at the two end portions 31 of the strap device 30 respectively. The retaining devices 5 each include a block or casing 50 having a groove or slot or passage 51 formed therein for slidably receiving or engaging with the strap device 30 and for allowing the casings 50 of the retaining devices 5 to be slidably attached or mounted or secured to the strap device 30, best shown in dotted lines in FIG. 7. The engaging members 32 of the strap device 30 may include a size or standard or thickness greater than the width of the passage 51 of the casing 50 for anchoring the casings 50 of the retaining devices 5 to the strap device 30 and for preventing the retaining devices 5 from being disengaged or separated from the strap device 30.

The retaining devices 5 each further include a spring biasing flap or member 53 extended from the casing 50 for contacting or engaging with the engaging member 32 of the strap device 30 (FIG. 3), and a carrier or retainer 54 extended from the spring biasing member 53 and preferable, but not necessary that the retainer 54 is perpendicular to the spring biasing member 53 for contacting or engaging with the engaging member 32 of the strap device 30 and the attachment 12 of the housing 10 (FIGS. 1-3 and 7-9) and for further anchoring or retaining or positioning the casing 50 of the retaining device 5 to the strap device 30, and also for anchoring or retaining or positioning the engaging member 32 of the strap device 30 and the attachment 12 of the housing 10 together, and also for preventing the retaining devices 5 and the strap device 30 from being disengaged or separated from the housing 10.

Figure 7:
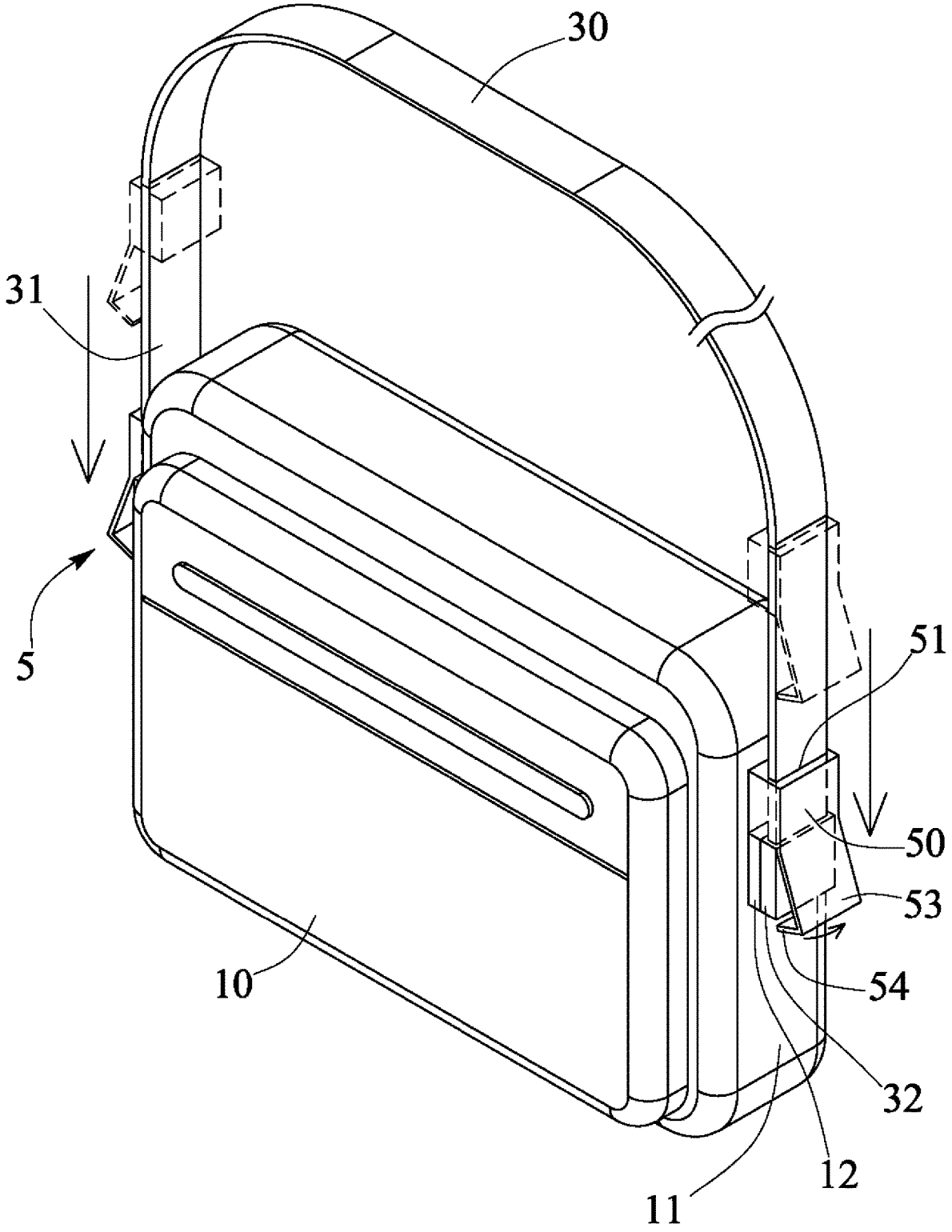
FIGS. 7, 8, 9 are other perspective views similar to FIG. 1, illustrating the operation of the carrying bag.
Figure 8:
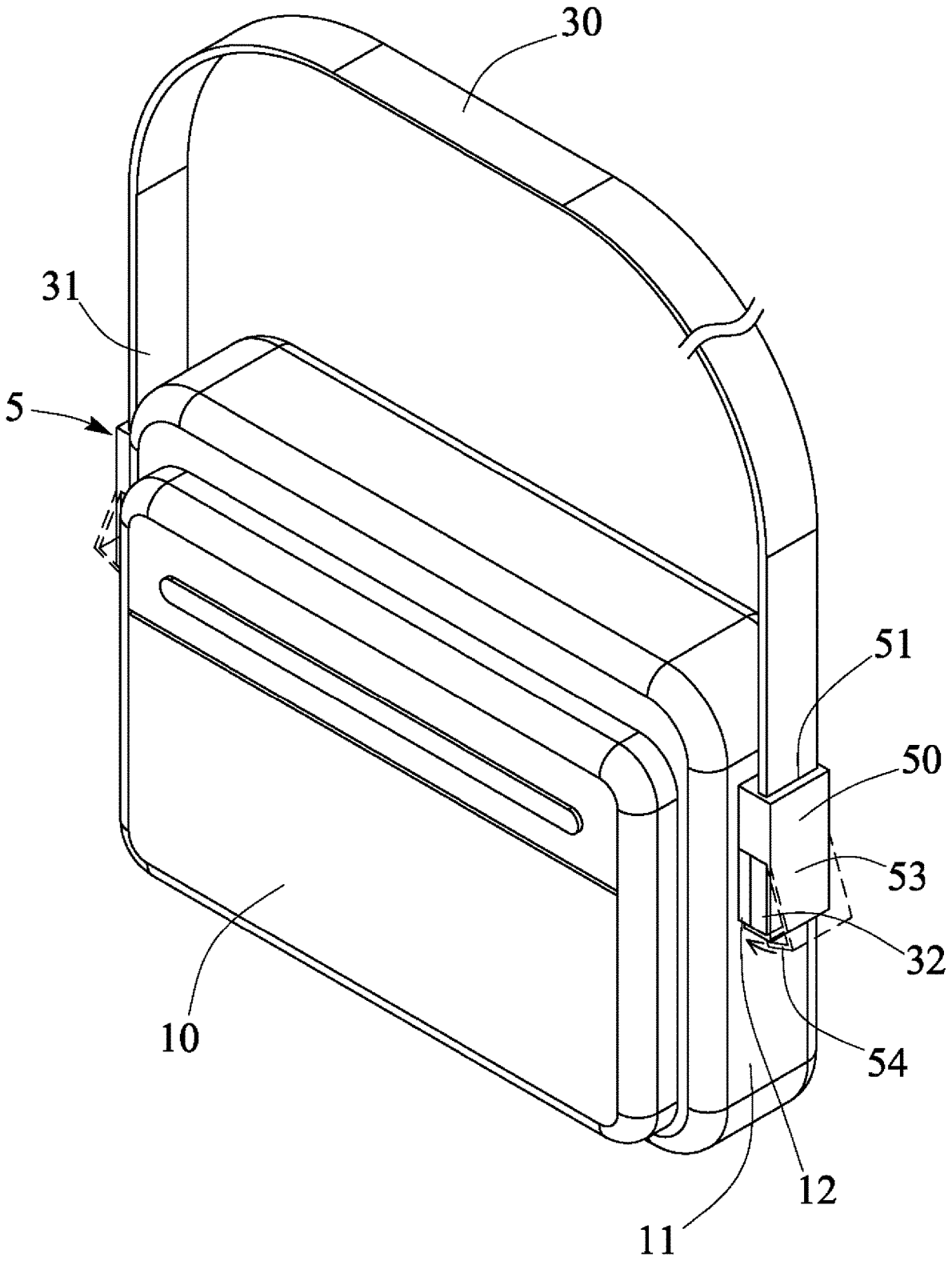

In operation, as shown in FIGS. 6 and 7, the engaging members 32 of the strap device 30 may first be engaged with the attachments 12 of the housing 10 respectively, particularly when the retaining devices 5 are disengaged or separated from the engaging members 32 of the strap device 30 respectively. As shown in FIGS. 7 and 8, the casings 50 of the retaining devices 5 may then be moved toward and to engage with the engaging members 32 of the strap device 30 respectively, and then to engage the retainers 54 of the retaining devices 5 with the engaging members 32 of the strap device 30 and the attachments 12 of the housing 10, and thus for anchoring or retaining or positioning the strap device 30 to the housing 10, and for preventing the strap device 30 from being disengaged or separated from the housing 10.

Figure 4:
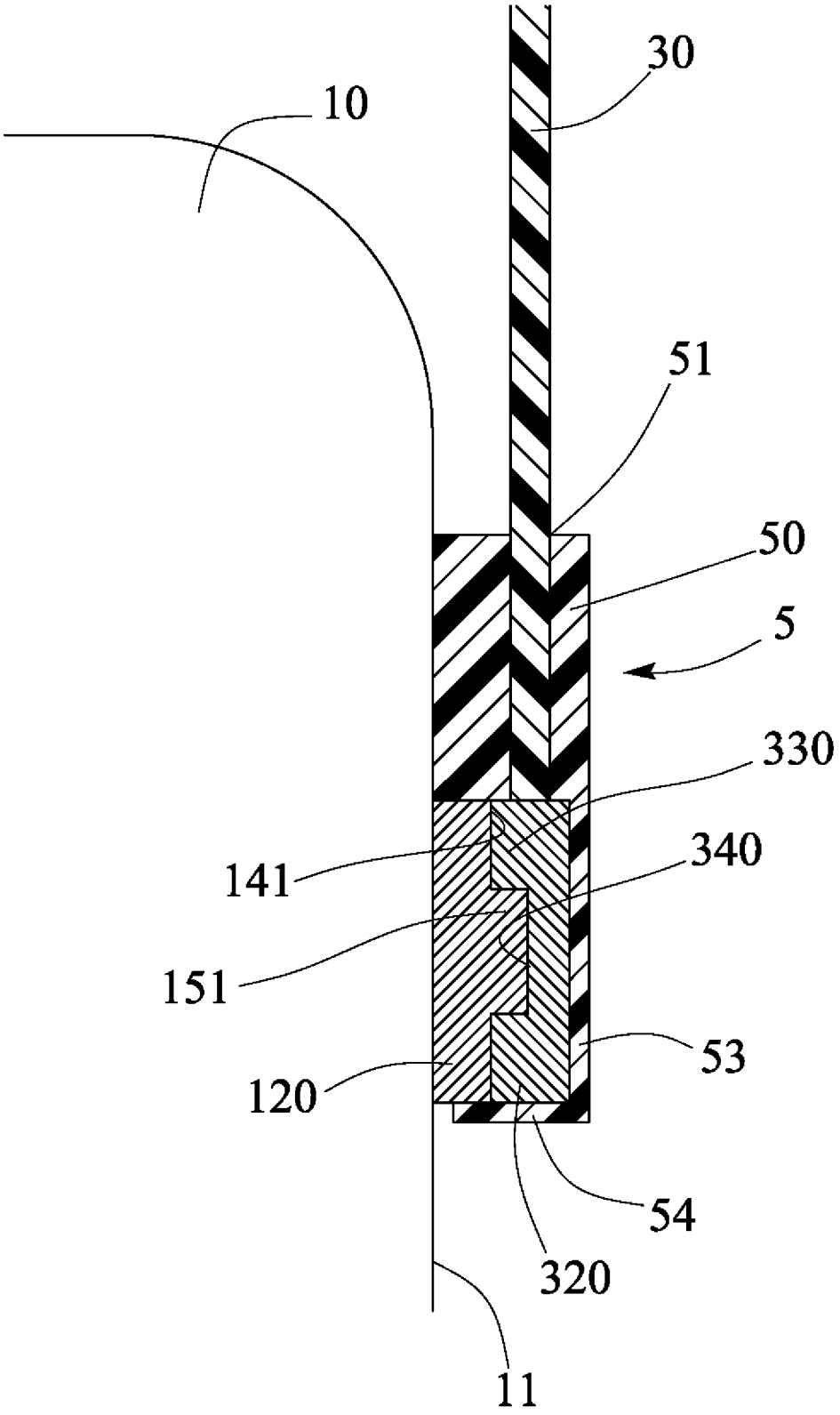
FIGS. 4, 5 are partial cross sectional views similar to FIG. 3, illustrating the other arrangement of the carrying bag.
Figure 5:
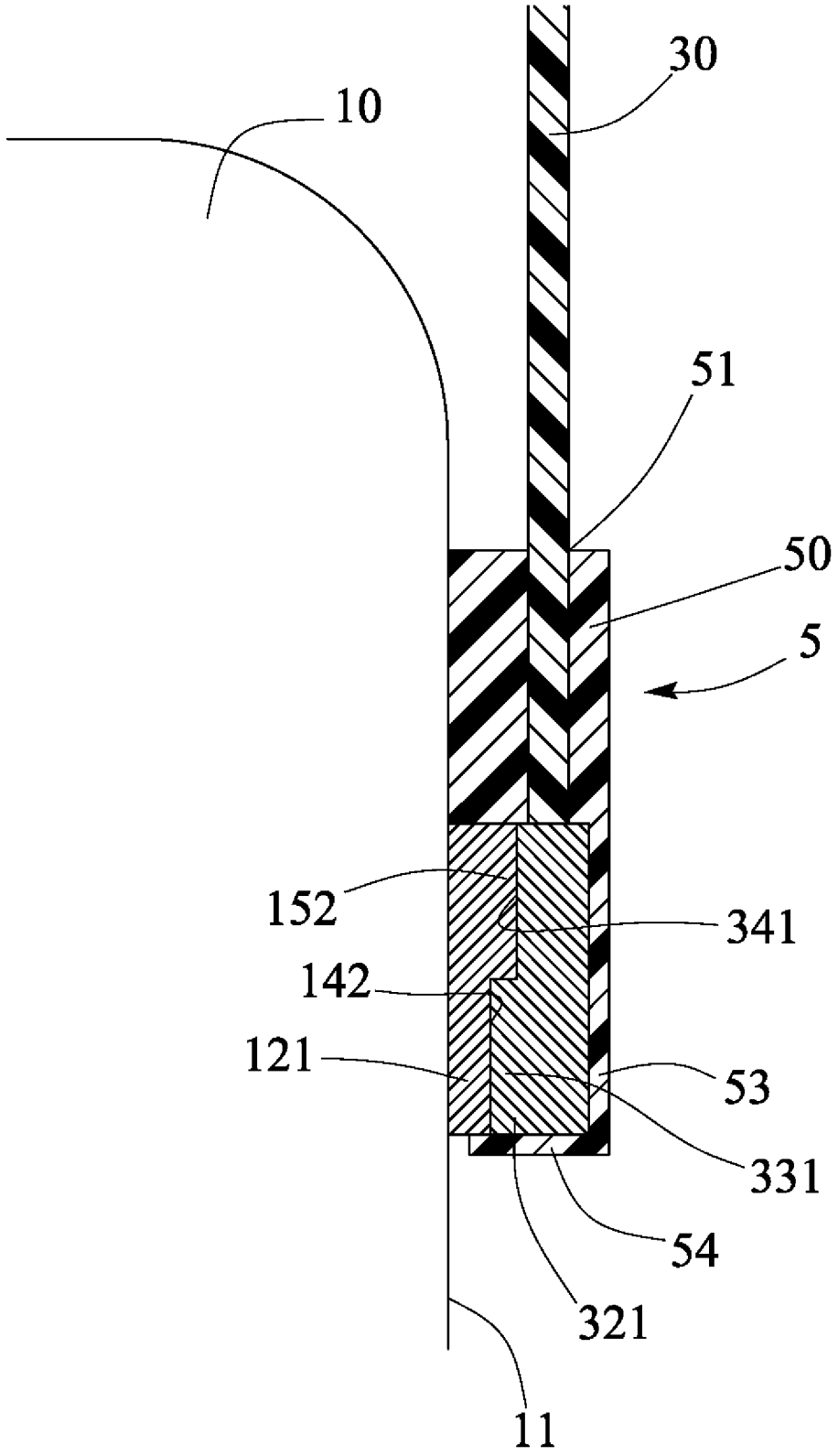

Alternatively, as shown in FIGS. 4 and 5, the attachments 120, 121 of the housing 10 may include the depressions 141, 142 and/or the protrusions 151, 152 of different numbers and/or geometric shapes or structures or configurations for engaging with the corresponding engaging members 320, 321 of the strap device 30 that may include the projections 330, 331 and/or the recesses 340, 341 having corresponding numbers and/or geometric shapes or structures or configurations, and for allowing the engaging members 320, 321 of the strap device 30 to be anchored or retained or positioned to the attachments 120, 121 of the housing 10 respectively.

Accordingly, the package or suitcase or carrying bag in accordance with the present invention includes an improved detachable carrying strap for easily and quickly and readily attaching to or being detached from the carrying bag and for firmly and solidly and stably attaching to or being detached from the carrying bag.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A carrying bag comprising:

a housing including two side portions, and two attachments attached to said side portions of said housing respectively, a strap device including two end portions, and two engaging members attached to said end portions of said strap device respectively for engaging with said attachments of said housing respectively, said engaging members of said strap device being selected from a magnetic member, and two retaining devices slidably attached to said strap device, said retaining devices each including a spring biasing member for contacting and engaging with said engaging member of said strap device, and a retainer extended from said spring biasing member for contacting and engaging with said engaging member of said strap device and said attachment of said housing and for anchoring and retaining said engaging member of said strap device and said attachment of said housing together.

2. The carrying bag as claimed in claim 1, wherein said retaining devices each include a casing having a passage formed in casing for slidably receiving and engaging with said strap device and for allowing said casing of said retaining device to be slidably attached to said strap device.

3. The carrying bag as claimed in claim 1, wherein said attachments of said housing each include a depression formed in said attachment, and said engaging members of said strap device each include a projection for engaging with said depression of said attachment of said housing and for anchoring said engaging members of said strap device to said attachments of said housing respectively.

4. The carrying bag as claimed in claim 1, wherein said engaging members of said strap device each include a recess formed in said engaging member, and said attachments of said housing each include a protrusion for engaging with said recess of said engaging member and for anchoring said engaging members of said strap device to said attachments of said housing respectively.

5. A carrying bag comprising:

a housing including two side portions, and two attachments attached to said side portions of said housing respectively, said attachments of said housing being selected from a magnetic member, a strap device including two end portions, and two engaging members attached to said end portions of said strap device respectively for engaging with said attachments of said housing respectively, and two retaining devices slidably attached to said strap device, said retaining devices each including a spring biasing member for contacting and engaging with said engaging member of said strap device, and a retainer extended from said spring biasing member for contacting and engaging with said engaging member of said strap device and said attachment of said housing and for anchoring and retaining said engaging member of said strap device and said attachment of said housing together.

* * * * *